US009131763B2

(12) United States Patent
Groberg et al.

(10) Patent No.: US 9,131,763 B2
(45) Date of Patent: Sep. 15, 2015

(54) CONTAINER FOR TABLEWARE

(76) Inventors: Jason Groberg, Clearfield, UT (US); Holli Groberg, Clearfield, UT (US)

( * ) Notice: Subject to any disclaimer, the term of this patent is extended or adjusted under 35 U.S.C. 154(b) by 3123 days.

(21) Appl. No.: 11/300,969

(22) Filed: Dec. 14, 2005

(65) Prior Publication Data

US 2006/0124503 A1 Jun. 15, 2006

Related U.S. Application Data

(60) Provisional application No. 60/636,257, filed on Dec. 14, 2004.

(51) Int. Cl.
*A45C 11/20* (2006.01)
*A45F 3/46* (2006.01)

(52) U.S. Cl.
CPC ..... *A45F 3/46* (2013.01)

(58) Field of Classification Search
CPC ..... A45F 3/46; A45F 3/00; A45C 11/20; B65D 51/28
USPC ..... 206/541, 223, 545, 581, 372, 373, 503; 220/504, 500, 288, 575, 521, 522, 524, 220/285, 523; 221/279
See application file for complete search history.

(56) References Cited

U.S. PATENT DOCUMENTS

| | | | | | |
|---|---|---|---|---|---|
| 1,327,948 | A | * | 1/1920 | Dennis | 206/541 |
| 1,458,679 | A | * | 6/1923 | Bishop | 126/261 |
| 1,676,621 | A | * | 7/1928 | Pittelkow | 220/844 |
| 2,780,385 | A | * | 2/1957 | Tupper | 220/797 |
| 3,061,136 | A | * | 10/1962 | Sterngart | 220/504 |
| 3,144,152 | A | * | 8/1964 | Kopp | 215/6 |
| 3,398,827 | A | * | 8/1968 | Laskin | 206/499 |
| 3,722,779 | A | * | 3/1973 | Chang | 220/574 |
| 3,768,691 | A | | 10/1973 | Cobb et al. | |
| 3,811,559 | A | | 5/1974 | Carter | |
| 3,854,624 | A | | 12/1974 | Canci | |
| 4,033,478 | A | * | 7/1977 | House | 221/279 |
| 4,126,248 | A | | 11/1978 | House | |
| 4,311,237 | A | * | 1/1982 | Hayes | 206/503 |
| 4,717,020 | A | * | 1/1988 | Viira | 206/372 |
| 4,911,295 | A | * | 3/1990 | Venegoni | 206/372 |
| 5,040,681 | A | * | 8/1991 | Grusin | 206/503 |
| 5,074,431 | A | | 12/1991 | Sendelbach | |
| 5,518,139 | A | * | 5/1996 | Trower et al. | 220/522 |
| 5,564,597 | A | * | 10/1996 | Koorse et al. | 221/96 |
| 5,595,302 | A | * | 1/1997 | Maydwell et al. | 206/541 |
| 5,705,212 | A | * | 1/1998 | Atkinson | 426/115 |
| D394,586 | S | | 5/1998 | Jessop | |
| 5,878,757 | A | * | 3/1999 | Hernandez | 132/287 |
| 6,059,179 | A | | 5/2000 | Giampapa | |
| 6,196,412 | B1 | * | 3/2001 | Cattell | 220/524 |
| 6,311,841 | B1 | | 11/2001 | Hodges | |
| 6,540,084 | B2 | * | 4/2003 | Silvers | 206/581 |
| 7,055,690 | B1 | * | 6/2006 | Valdez et al. | 206/449 |
| 7,353,970 | B1 | * | 4/2008 | Harrison-Coats | 221/279 |

* cited by examiner

*Primary Examiner* — Steven A. Reynolds

(57) ABSTRACT

A container is disclosed for facilitating storing and transporting tableware. The container may be particularly useful for picnics or other outdoor activities in which meals are served. The container may include three compartments that may be removably attached together. A first compartment may have various chambers for receiving knives, forks or spoons. The first compartment may also include a cup chamber for receiving cups. The cup chamber may include a biasing member to assist in dispensing the cups. A second compartment may be attachable to the first compartment, and may be configured for receiving napkins. A third compartment may be attachable to the first compartment and may be configured for receiving plates. A handle may be provided to carry the container as a single unit.

26 Claims, 8 Drawing Sheets

CONTAINER FOR TABLEWARE

CROSS-REFERENCE TO RELATED APPLICATIONS

This application claims the benefit of U.S. Provisional Application No. 60/636,257, filed Dec. 14, 2004, which is hereby incorporated by reference herein in its entirety, including but not limited to those portions that specifically appear hereinafter, the incorporation by reference being made with the following exception: In the event that any portion of the above-referenced provisional application is inconsistent with this application, this application supercedes said above-referenced provisional application.

STATEMENT REGARDING FEDERALLY SPONSORED RESEARCH OR DEVELOPMENT

Not Applicable.

BACKGROUND

1. The Field of the Invention

The present disclosure relates generally to containers, and more particularly, but not necessarily entirely, to containers for organizing and carrying tableware that may be particularly useful for picnics or other outdoor activities.

2. Description of Related Art

It is common to transport tableware for use in picnics, camping or other outdoor recreational activities in which meals are served. Several different items of tableware may be useful, such as plates, napkins, cups, bowls, and utensils including knives, forks and spoons. It may be desirable to arrange the tableware in a manner such that the tableware occupies as little space as possible to facilitate storing the tableware in small areas or vehicles, and to facilitate handling the tableware. It may also be desirable to allow the tableware to be accessible while being protected from wind such that the tableware may not be easily blown away during use in the outdoors.

Picnic baskets known in the art are commonly used to carry tableware as well as food items. A drawback of the known picnic baskets is that the items in the picnic baskets are often mixed together such that finding and accessing a particular item may become difficult. Also, organizing tableware items in a compact configuration may be difficult in the traditional picnic basket. Moreover, dispensing of the tableware may not be easily accomplished.

An example of a container known in the art for carrying tableware is disclosed in U.S. Pat. No. 6,059,179, granted May 9, 2000 to Giampapa. The container has a compartment into which various types of tableware may be placed. However, separate compartments are not provided such that mixing of items may occur. Moreover, placement of the items in the container in a compact arrangement may be difficult to accomplish. Similarly, U.S. Pat. No. 6,311,841, granted Nov. 6, 2001 to Hodges, discloses a picnic supply case that is configured to function as a lap tray. Accordingly, the configuration of the case may not be suitable for arranging the tableware in a compact configuration.

Likewise, U.S. Pat. No. 3,811,559, granted May 21, 1974 to Carter, discloses a container for picnic accessories. However, the container does not have compartments configured for holding specific tableware items such as utensils or cups, for example. Accordingly, the container does not facilitate arranging tableware in a compact and well organized configuration.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
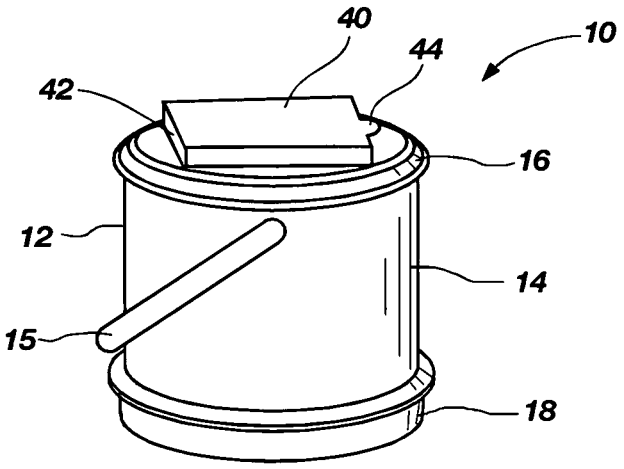
FIG. 1 is a perspective view of a container in accordance with the principles of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

The publications and other reference materials referred to herein to describe the background of the disclosure, and to provide additional detail regarding its practice, are provided solely for their disclosure prior to the filing date of the present application. Nothing herein is to be construed as a suggestion or admission that the inventors are not entitled to antedate such disclosure, or to distinguish the present disclosure from the subject matter disclosed in the reference materials.

It must be noted that, as used in this specification and the appended claims, the singular forms “a,” “an,” and “the”

include plural referents unless the context clearly dictates otherwise. Moreover, as used herein, the terms "comprising," "including," "containing," "characterized by," and grammatical equivalents thereof are inclusive or open-ended terms that do not exclude additional, unrecited elements or method steps.

Referring now to FIG. 1, a perspective view is shown of a container, indicated generally at 10, in accordance with the principles of the present disclosure. It will be understood that the container 10 may be configured for receiving and organizing tableware, such as knives, forks, spoons, cups, plates, napkins, and/or bowls, for example. It will also be understood that other items may be placed in the container 10.

Figure 2:
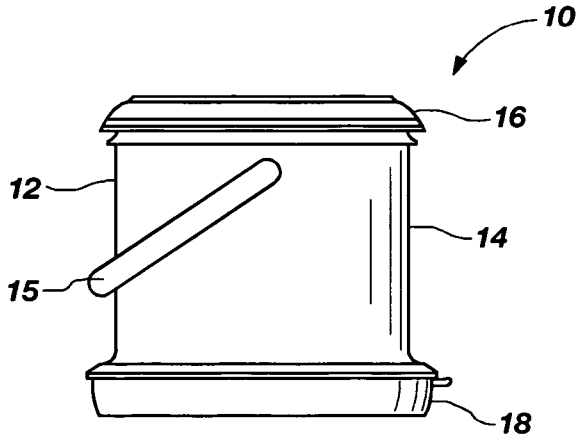
FIG. 2 is a side view of a container in accordance with the principles of the present disclosure.

A side view of an embodiment of the container 10 is shown in FIG. 2. The container 10 may include a housing 12 defining a plurality of compartments, including a middle or first compartment 14, a top or second compartment 16, and a bottom or third compartment 18. The first compartment may be configured for receiving items including tableware items such as utensils and cups. The second compartment 16 may be configured for receiving items such as napkins, and the third compartment 18 may be configured for receiving items such as plates. It will be understood, however, that different items may be stored in the first compartment 14, the second compartment 16, and the third compartment 18, and that the particular type tableware items in each of the compartments may vary within the scope of the present disclosure.

A handle 15 may be provided for carrying the container 10. The handle 15 may be pivotally attached to the first compartment 14 to enable the handle 15 to be rotated or folded to a compact position against the first compartment 14 so that the container 10 may occupy less space. The handle 15 may also be rotated to an upward position for carrying the container 10 in a manner similar to a bucket. It will be understood that alternative embodiments of the present disclosure may include a handle that maybe attached to the second compartment 16 or the third compartment 18. Moreover, further alternative embodiments of the handle 15 may be non-rotatably attached to one of the compartments, or the handle may be formed as a flexible strap or any other variety of handle device known to those skilled in the art.

Figure 3:
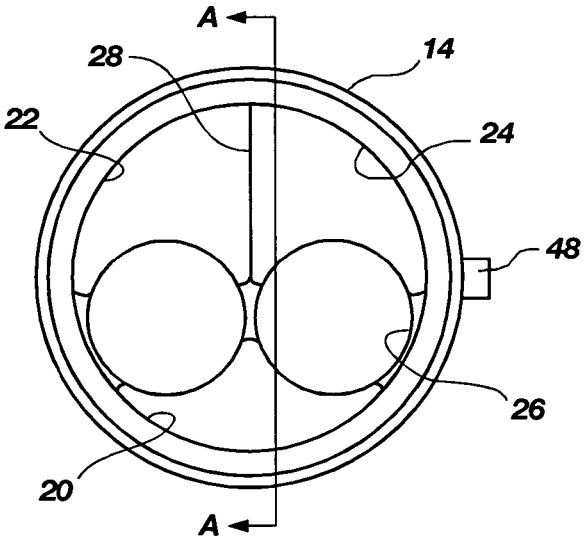
FIG. 3 is a top view of a first compartment of a container.

As shown in FIG. 3, which shows a top view of a first compartment 14, a plurality of chambers may be formed in the first compartment for receiving different varieties of tableware. For example, the first compartment 14 may include a knife chamber 20 for receiving knives. Similarly, the first compartment 14 may include a spoon chamber 22 for receiving spoons, a fork chamber 24 for receiving forks, and one or more cup chambers 26 for receiving cups. It will be understood that the size, shape, quantity and position of the chambers may vary within the scope of the present disclosure. For example, the position of the knife chamber 20, the spoon chamber 22, and the fork chamber 24, may be interchangeable. Additionally, some embodiments of the present disclosure may also include a bowl chamber in addition to or instead of one of the cup chambers 26. Other embodiments may include a single chamber for receiving knives, forks and spoons. Moreover, other embodiments may include additional chambers configured for receiving other items.

One or more dividers 28 may be formed within the first compartment 12 for defining the chambers. It will be understood that the dividers 28 may be sized, shaped and positioned as desired to form suitable chambers within the scope of the present disclosure. In some embodiments, the dividers may extend a majority or substantially entire height of the first compartment 12 so as to allow little if any space in the first compartment 12 that is not apportioned to a particular chamber. Accordingly, the chambers may be substantially completely separated from each other. Alternatively, other embodiments may include dividers formed as bars or partial walls that do not extend the full height of the first compartment 12 such that spaces may be provided between the dividers to interconnect the chambers.

Figure 4:
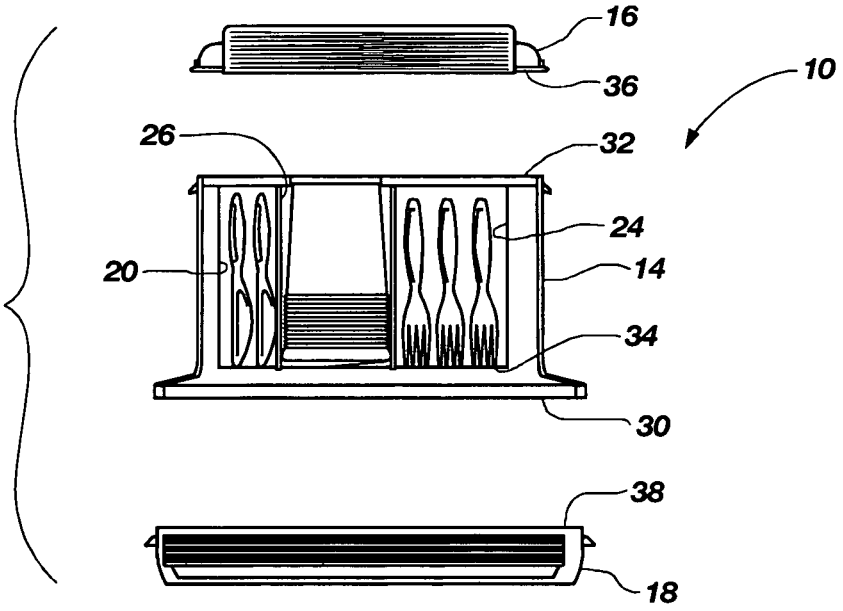
FIG. 4 is an exploded cross sectional view of a container as shown taken along line A-A of FIG. 3.

Referring to FIG. 4, an exploded cross-sectional view is shown of the container 10 taken along the line A-A of FIG. 3. It will be appreciated that the knife chamber 20, the spoon chamber 22 and the fork chamber 24 may be configured to receive knives, spoons, and forks, respectively, in an upright orientation. Accordingly, the utensils may be stored in an organized fashion and easily accessed for use. Moreover, the cup chamber 26 may be configured to receive a cup or a plurality of cups stacked together to be stored and dispensed in an organized fashion.

The first compartment 14 may have a lower portion 30 and an upper portion 32. The lower portion 30 may include a floor 34 for confining movement of the tableware, whereas the upper portion 32 may be open to allow access to the first compartment 14 when the second compartment 16 is removed from the first compartment 14. Accordingly, a lower portion 36 of the second compartment 16 may be removably attachable to the upper portion 32 of the first compartment 14. It will be understood that any variety of attachment means known to those skilled in the relevant art, such as a clamping, snap-fit, frictional, or threaded attachment, for example, may be used to removably attach the second compartment 16 to the first compartment 14. Some embodiments of the present disclosure may be configured such that the first compartment 14 may be attachable to the second compartment 16 by nature of a fit between the first compartment 14 and the second compartment 16 without an additional fastening device. Other embodiments may utilize any variety of attaching devices, such as clasps, buckles, straps, or fasteners, for example, to attach the first compartment 14 to the second compartment 16. Once the second compartment 16 is attached to the first compartment 14, the tableware within the first compartment 14 may be securely confined for safely storing the tableware, and for protecting the tableware from the environment.

The third compartment 18 may also have an upper portion 38 that may be removably attachable to the lower portion 30 of the first compartment 14. Similar to the connection between the first compartment 14 and the second compartment 16, the connection between the first compartment 14 and the third compartment 18 may be formed as any variety of attachment means known to those skilled in the art to allow the first compartment 14 and the third compartment 18 to be removably joined together.

Figure 5:
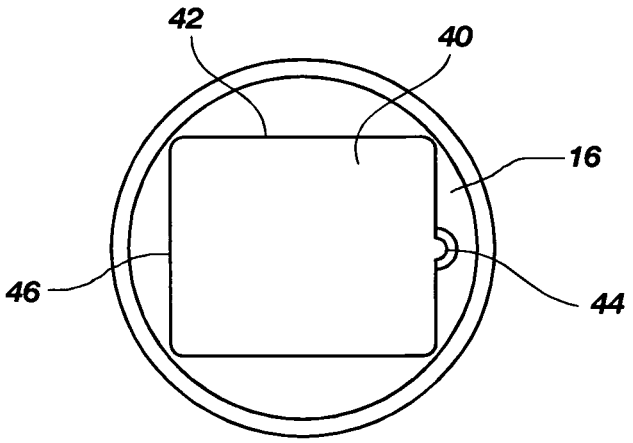
FIG. 5 is a top view of a second compartment of a container.

Referring now to FIG. 5, which shows a top view of the second compartment 16, a lid 40 may be provided for removably covering an upper chamber 42. The lid 40 may have a tab 44 for grasping to open and close the lid 40. The lid 40 may have a hinge at 46 such that the lid 40 may be configured to swing to an open and closed position. The hinge 46 may be formed in any manner known to those skilled in the art. One embodiment of the hinge 46 may be formed as a living hinge. For example, a living hinge may be a hinge made from materials such as thermoplastic polymers which may be formed as a single piece and which may also be formed as an integral part of the second compartment 16. Other embodiments of the hinge 46 may be formed of other materials and the hinge 46 may be formed in multiple parts. Moreover, other embodiments of the present disclosure may not include a hinge attaching to the lid 40 such that the lid 40 may be completely removable from the upper chamber 42. Similar to the connection between the first compartment 14 and the second compartment 16, and the connection between the first compartment 14 and the third compartment 18, the connection between the lid 40 and the structure forming the upper chamber 42 may be formed as any variety of attachment means known to those skilled in the art. Accordingly the lid 40 may be removably joined to the structure forming the upper chamber 42, such that the upper chamber 42 may be covered and opened to access the contents of the upper chamber 42. Other embodiments of the lid 40 may include a slot or opening for allowing napkins to be dispensed therethrough without removal of the lid 40.

One embodiment of the present disclosure may include an upper chamber 42 configured to receive tableware items such as napkins. The lid 40 may have a polygonal shape, such as a square shape, for covering a correspondingly shaped upper chamber 42. It will be understood that the lid 40 may have other shapes, such as round shapes for example, to correspond to chambers of other shapes within the scope of the present disclosure. Accordingly, the lid 40 may cover only a portion of the second compartment 16, or substantially all of the second compartment 16.

Figure 6:
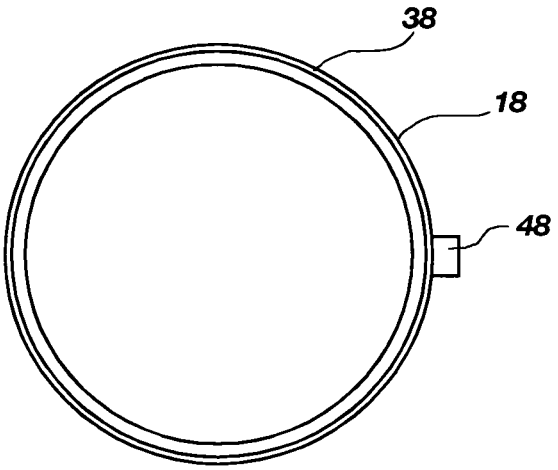
FIG. 6 is a top view of a third compartment of a container.
Figure 8:
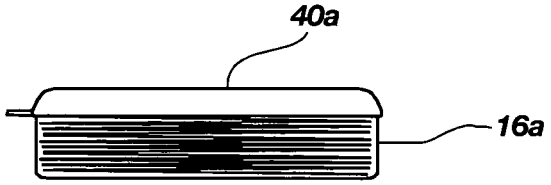
FIG. 8 is a side view of an alternative embodiment second compartment.
Figure 9:
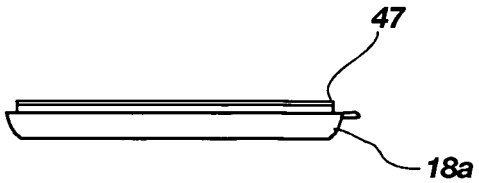
FIG. 9 is a side view of an alternative embodiment third compartment.

An alternative embodiment second compartment 16*a* is shown in FIG. 8, in which a lid 40*a* may be configured to extend across substantially all of the second compartment 16*a*. It will be understood that various other shapes and configurations may be used within the scope of the present disclosure. Referring now to FIG. 6, a top view of the third compartment 18 is shown. As previously mentioned, the third compartment 18 may be configured for receiving tableware items, such as plates. Accordingly, the third compartment 18 may be sized and shaped to receive a stack of plates. One embodiment of the third compartment 18 may have a diameter that is greater than the diameter of the first compartment 14 to accommodate plates of larger diameters. It will be understood, however, that in other embodiments of the present disclosure, the diameter of the third compartment 18 may be the same or even smaller than the first compartment 14, and that other items besides plates may be carried in the third compartment 18. An alternative embodiment third compartment 18*a* is shown in FIG. 9. The alternative embodiment third compartment 18*a* may have a shorter dimension from top to bottom and may include an inner lip 47 as part of the means for attaching the third compartment 18*a* to the first compartment 14. It will be understood that compartments of various other configurations may also be used in accordance with the principles of the present disclosure.

The third compartment 18 may also include one or more tabs 48 for applying a force to remove and attach the third compartment 18 to the first compartment 14. It will be understood that the size, location and quantity of tabs 48 may vary within the scope of the present disclosure.

Figure 7:
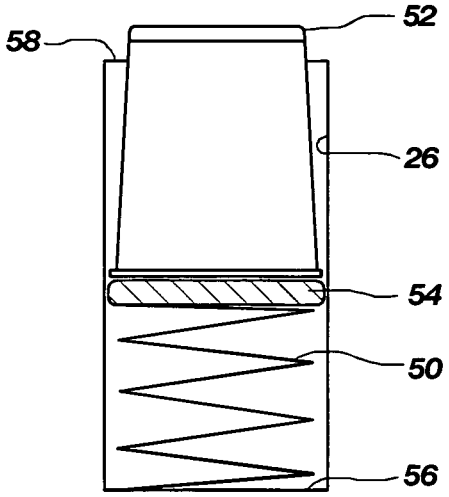
FIG. 7 is a side cross sectional view of a cup chamber.

Referring now to FIG. 7, a side cross sectional view of one embodiment of a cup chamber 26 is shown. The cup chamber 26 may include a biasing member or spring 50 to lift a cup 52 or stack of cups out of the cup chamber 26 to facilitate accessing and dispensing the cup 52. The spring 50 may be formed of a resilient material in a manner known in the art to provide a biasing force. The spring 50 may be interposed between a platform 54 and a floor 56 of the cup chamber 26. Accordingly, the cup 52 may be supported on the platform 54 such that when the second compartment 16 is placed on the first compartment 14, the second compartment 16 may force the cup 52 or stack of cups, further into the cup chamber 26 closer toward the floor 56 of the cup chamber 26 against the force of the spring 50. This allows the cups to be stored in a compact and organized configuration. When the second compartment 16 is removed from the first compartment 14, the spring 50 may then force the platform 54 and the cup 52 in a direction away from the floor 56 such that the cup 52 may extend out of an opening 58 of the cup chamber 26. The cup 52 may then be easily accessed.

It will be understood that some embodiments of the cup chamber 26 may not include the platform 54 or spring 50. Also, some embodiments of the present disclosure may include a spring 50 and platform 54 formed as a single piece member. Moreover, other items, such as bowls, may be stored in chambers having the spring 50 and platform 54.

It will be appreciated that in one embodiment of the present disclosure, the first compartment 14, the second compartment 16 and the third compartment 18 may be formed having different heights. The first compartment may be configured to form greater than half of the total height of the container 10 to accommodate utensils oriented in a upright position, whereas a height required to accommodate a stack of napkins or a stack of plates, in the second compartment 16 and third compartment 18, respectively, may be somewhat less than half of the total height of the container 10. Other embodiments of the present disclosure may include compartments of substantially equal heights.

It will also be appreciated that alternative embodiments of the present disclosure may include a container having a first compartment only. Other alternative embodiments may include a first compartment and either a second compartment or a third compartment only. Further alternative embodiments of the present disclosure may include containers having any number of compartments greater than three. Thus, containers may be formed with any number of compartments within the scope of the present disclosure. Moreover, it will be understood that alternative embodiments of the present disclosure may have different arrangements of the compartments. For example, one alternative embodiment may include the first compartment 14 positioned on a lowermost portion of the container, with the third compartment 18 interposed between the first compartment 14 and the second compartment 16. Similarly, any other arrangement of the compartments may be used within the principles of the present disclosure.

It will be understood that the container 10 disclosed in accordance with the principles of the present disclosure may be particularly useful for outdoor purposes in which meals are served, such as picnics, for example. Accordingly, the tableware used in connection with the container 10 may be disposable, such as paper plates and cups, and plastic utensils. Moreover, the container 10 of the present disclosure may be provided in combination with tableware for sale as a unit. Accordingly, the container 10 may form a type of packaging for sale of tableware. It will also be understood that the container 10 may also be used with non-disposable tableware and/or other items as well.

It will be understood that the components of the present disclosure may be constructed of any suitable material known in the art. For example, the container 10 may be constructed of various types of plastics, metals, or composite materials within the scope of the present disclosure.

In use, the tableware may be loaded into the container 10, either before purchasing the container 10 or at a later date using available tableware from another source. Knives, forks, spoons, cups, napkins and plates may each be placed in a separate chamber. The second compartment 16 and the third compartment 18 may be attached to the first compartment 14. Accordingly, all of the tableware necessary for a meal may be stored together in a single container, and preparation for an outdoor meal may thereby be facilitated. Once access to the tableware is desired, the second compartment 16 may be removed from the first compartment 14, and the third compartment 18 may also be removed from the first compartment 14 such that the three compartments may be set on a table for easy access to all of the different types of tableware. The tableware may remain in the compartments for dispensing to maintain an organized arrangement and prevent the tableware from being blown away in the wind. When the meal is completed, the second compartment 16 and the third compartment 18 may be reattached to the first compartment 14 so that the tableware remaining in the container 10 can be easily and quickly packed away. The container 10 may therefore be particularly useful for hurried situations in which people are on the go.

Reference will now be made to FIGS. 10-13 to describe an alternative embodiment of the present disclosure. As previously discussed, the presently disclosed embodiments of the disclosure illustrated herein are merely exemplary of the possible embodiments of the disclosure, including that illustrated in FIGS. 10-13.

It will be appreciated that the alternative embodiment of the disclosure illustrated in FIGS. 10-13 may contain many of the same structures represented in FIGS. 1-9 and only the new or different structures will be explained to most succinctly explain the features which come with the embodiments of the disclosure illustrated in FIGS. 10-13.

Figure 10:
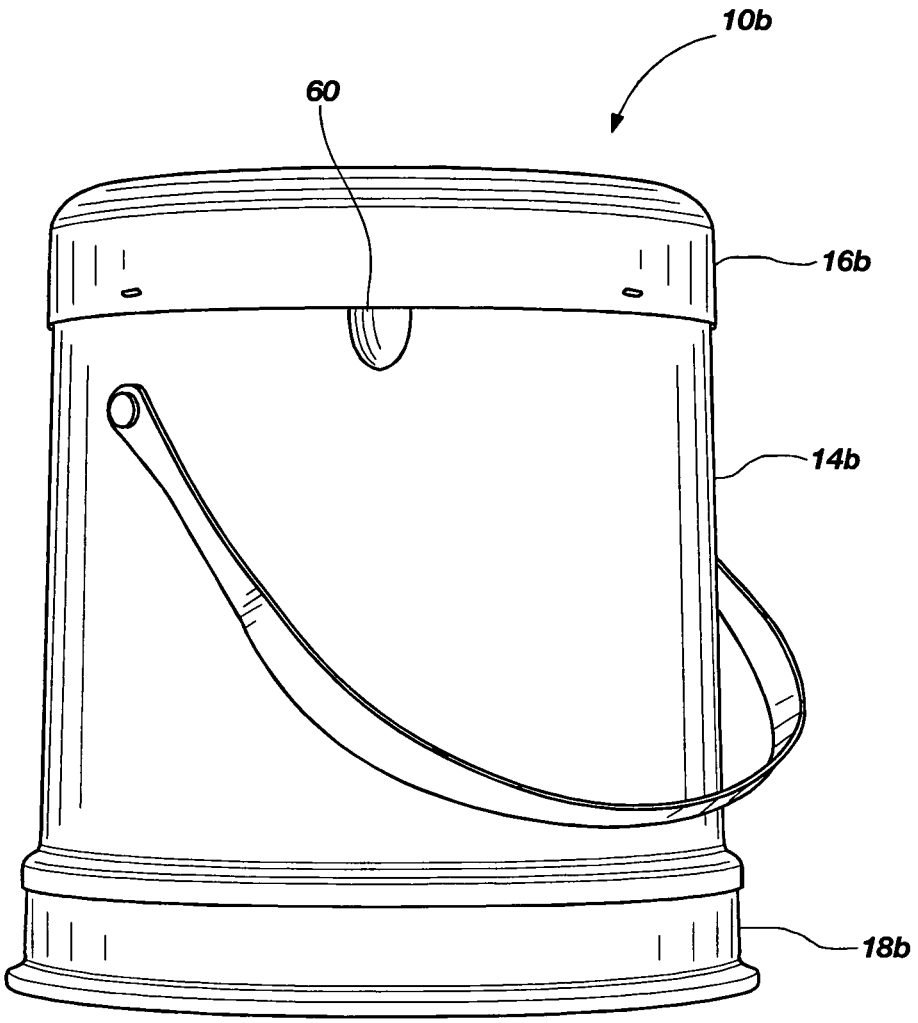
FIG. 10 is a side view of an alternative embodiment container.

FIG. 10 illustrates is a side view of an alternative embodiment container, indicated generally at 10*b*. The container 10*b* may include a first compartment 14*b*, a second compartment 16*b* and a third compartment 18*b*, similar to the previously disclosed embodiments. The second compartment 16*b* may be attachable to the first compartment 14*b* using a snap fit engagement of any variety known in the art for attaching two components together. One or more recesses 60 may be formed in the first compartment 14*b* to facilitate grasping an underside of the second compartment 16*b* for applying an upward force on the second compartment 16*b* to remove the second compartment 16*b* from the first compartment 14*b*. Accordingly, the second compartment 16*b* may be removable from the first compartment 14*b*, and the third compartment 18*b* may be removable from the first compartment 14*b* as shown most clearly in FIG. 11. It will be understood that FIG. 11 depicts a perspective view of the container 10*b* with the compartments detached from each other.

Figure 11:
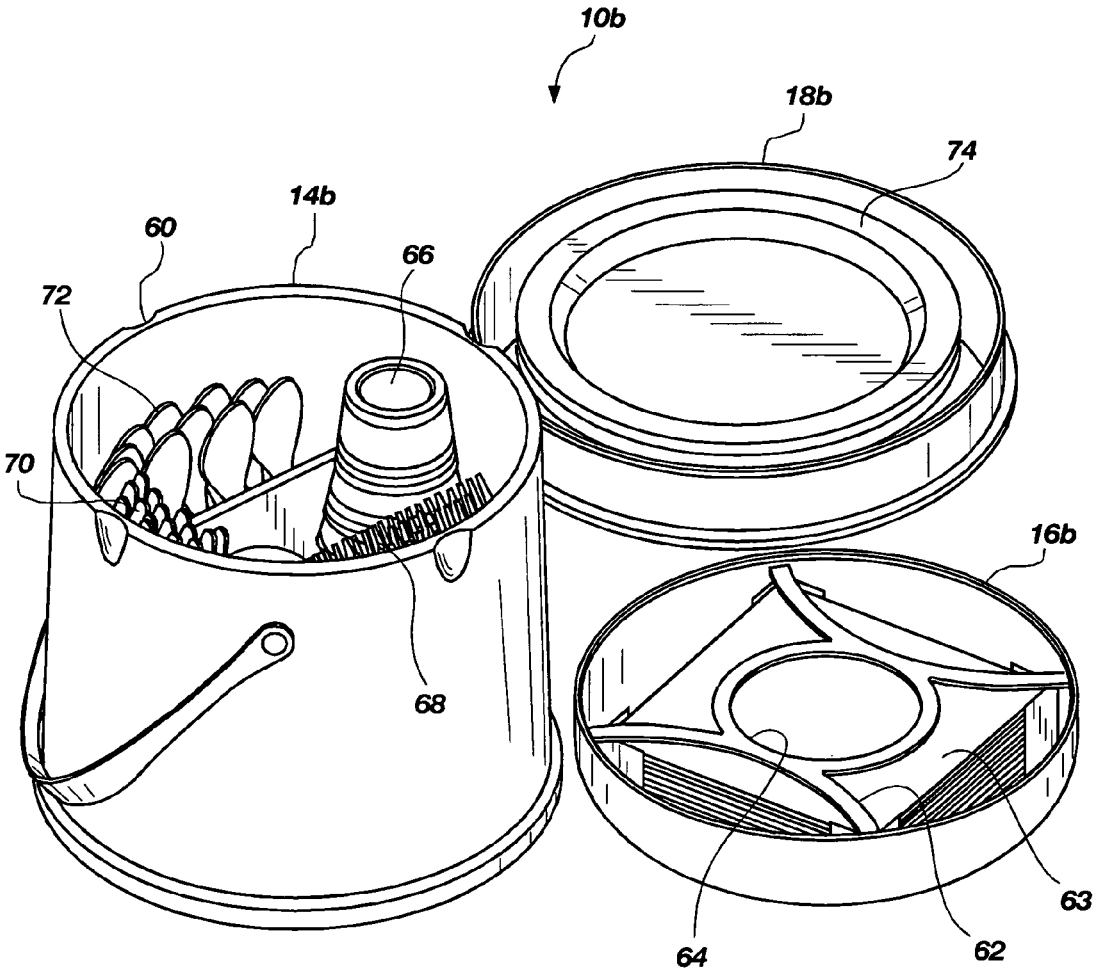
FIG. 11 is a top perspective view of the components of the container of FIG. 10 disassembled.

As shown in FIG. 11, the second compartment 16*b* is inverted as compared to the orientation of the second compartment 16*b* in FIG. 10. The second compartment 16*b* may include a support 62 for holding napkins 63. The support 62 may include an opening 64 for passing the napkins 63 therethrough. Alternatively, the napkins 63 may be accessed by moving the support 62. Accordingly, the support 62 may be hingedly attached as part of the second compartment 16*b*, or the support may be configured to be completely separated from the remainder of the second compartment 16*b*. This may also facilitate placement of new napkins 63 in the second compartment 16*b*. It will also be understood that the support 62 may have various different shapes and configurations within the scope of the present disclosure. Accordingly, the support 62 may be useful to facilitate holding and removing the napkins 63 and preventing the napkins 63 from being blown away in windy conditions.

Figure 12:
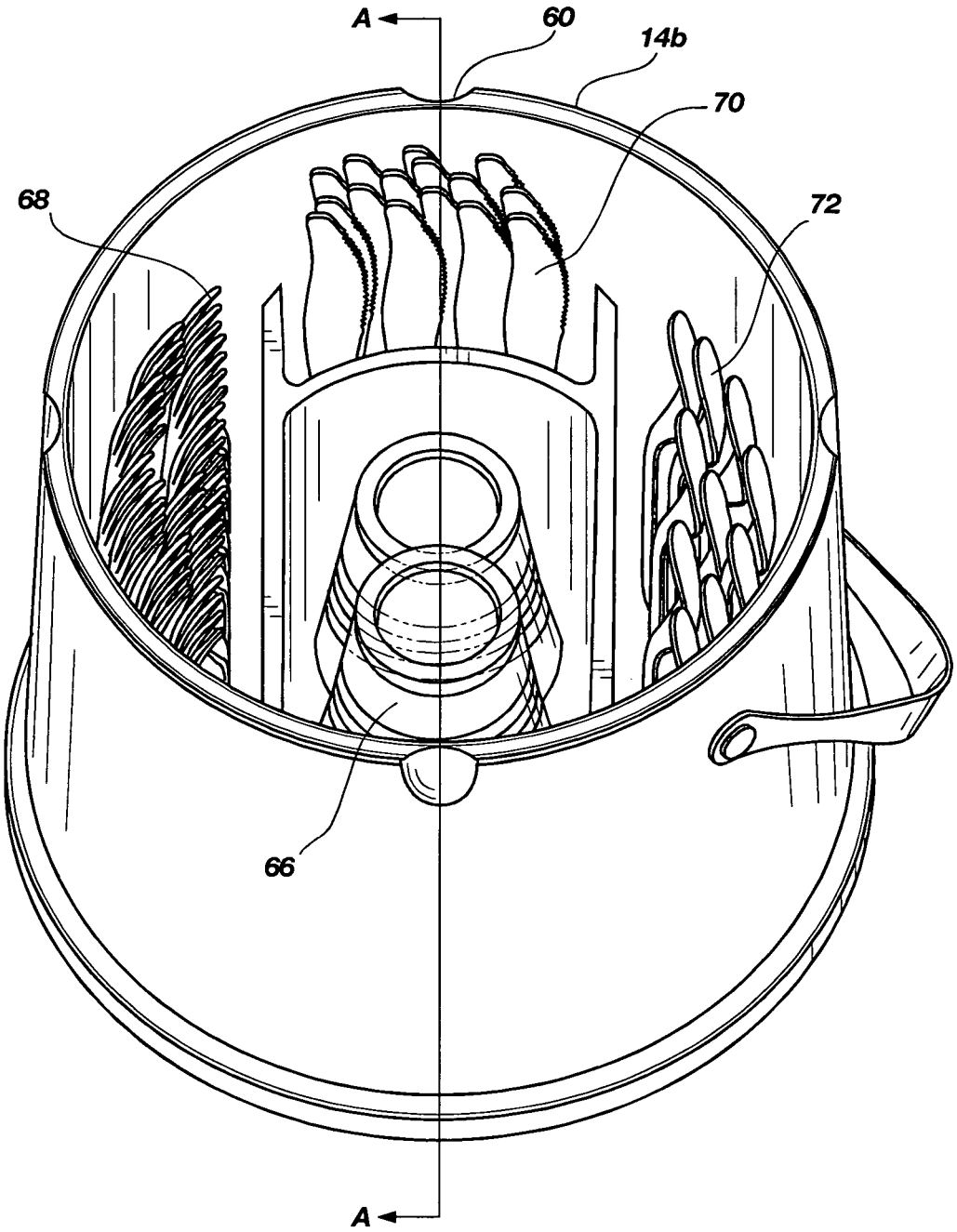
FIG. 12 is a top perspective view of a first component of the container of FIG. 10.

As shown in FIG. 12, which shows a top perspective view of the first compartment 14*b*, the first compartment 14*b* may have various different configurations of chambers for holding tableware such as cups 66, forks 68, knives, 70, and spoons 72, for example. It will also be understood that plates 74 may be stored in the third compartment 18*b*, or any other variety of items may be stored in various of the compartments or chambers of the container 10*b*.

Figure 13:
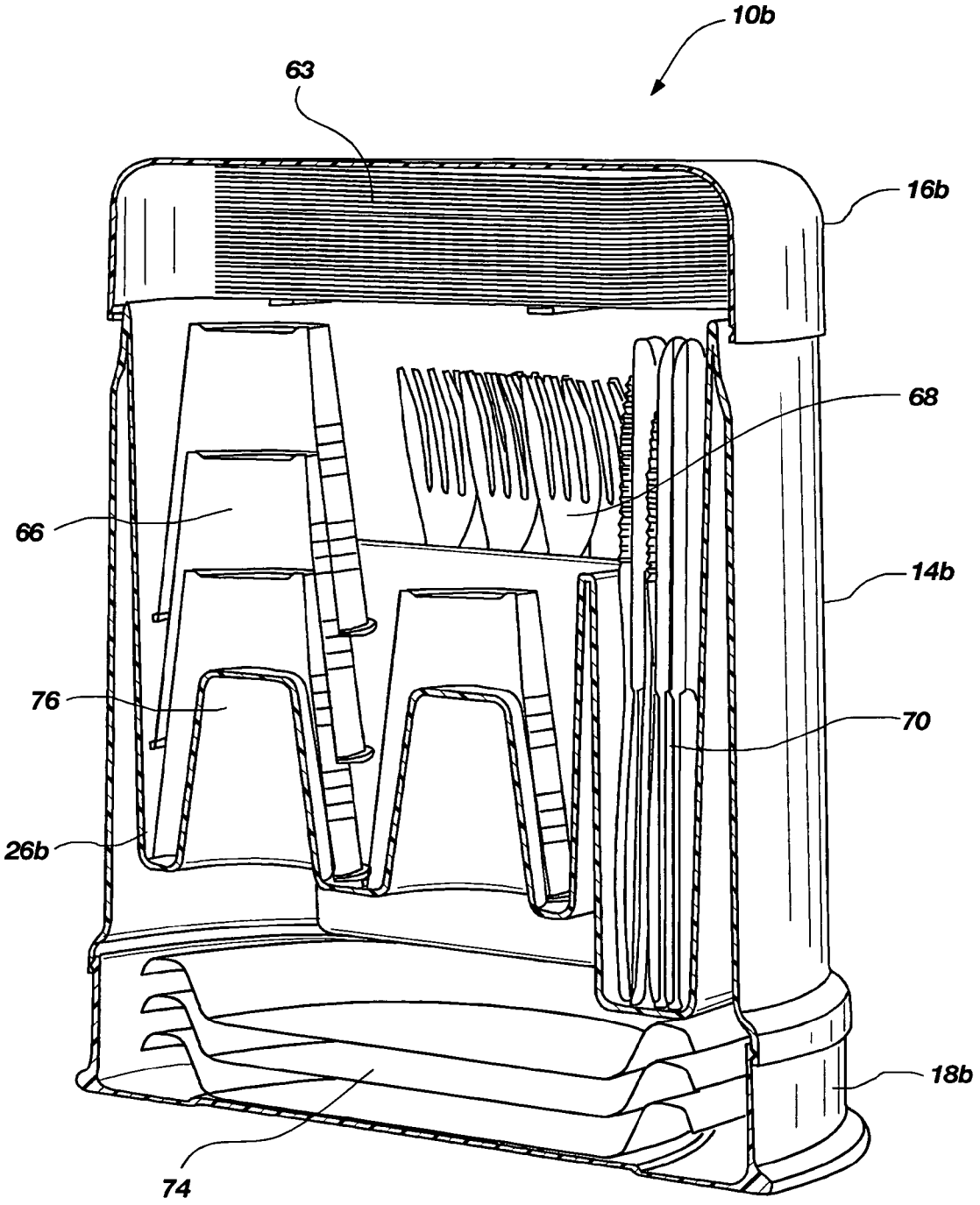
FIG. 13 is a cross-sectional perspective view of the container of FIG. 10 as viewed from section A-A in FIG. 12.

As shown in FIG. 13, which shows a perspective cross sectional view of the container 10*b*, as viewed from section A-A in FIG. 12, cup chambers 26*b* may be provided without a spring or biasing member. Some embodiments of the present disclosure may include cup supports 76 for holding the cups 66 in place. The cup supports 76 may include protrusions in the cup chambers 26*b* such that the cups 66 may be stacked on the protrusions to reduce movement of the cups 66. It will be understood, however, that other embodiments of the container may be provided without the cup supports 76.

It will also be understood that another alternative embodiment of the present disclosure may be provided in which an external housing may be provided as a separate container such that the first compartment, the second compartment and/or the third compartment may be removably insertable into the external housing. Accordingly, the external housing may form a container or bucket for receiving the compartments therein in any order, and one or more of the compartments may be removed from the housing for dispensing the tableware. The compartments may or may not be attachable to each other in different embodiments of the disclosure. Thus, the external housing may form an attachment means for removably attaching the first compartment, the second compartment and/or the third compartment. It will be understood that any number of compartments in various different configurations may be used with this embodiment.

It will be appreciated that the structure and apparatus disclosed herein is merely one example of a means for separating utensils, a means for dispensing cups, a means for receiving napkins, a means for receiving plates, and a means for removably attaching the first compartment, the second compartment and the third compartment. It should be appreciated that any structure, apparatus or system which performs functions the same as, or equivalent to, those disclosed herein are intended to fall within the scope of a means for separating utensils, a means for dispensing cups, a means for receiving napkins, a means for receiving plates, or a means for removably attaching the first compartment, the second compartment and the third compartment. This includes those structures, apparatus or systems which are presently known, or which may become available in the future. Anything which functions the same as, or equivalently to, a means for separating utensils, a means for dispensing cups, a means for receiving napkins, a means for receiving plates, or a means for removably attaching the first compartment, the second compartment and the third compartment, falls within the scope of such element.

In accordance with the features and combinations described above, a useful method of containing tableware includes the steps of:

a) placing at least one cup in a cup chamber in a first compartment;

b) placing at least one utensil in at least one utensil chamber in the first compartment;

c) placing at least one napkin in a second compartment and removably attaching the second compartment to the first compartment; and d) placing at least one plate in a third compartment and removably attaching the third compartment to the first compartment.

Those having ordinary skill in the relevant art will appreciate the advantages provide by the features of the present disclosure. For example, it is a feature of the present disclosure to provide a container device that is simple in design, manufacture and use. Another feature of the present disclosure is to provide such a container that may be compact and lightweight and that may facilitate storage and handling of tableware. It is a further feature of the present disclosure, in accordance with one aspect thereof, to provide a container that is useful for organizing and dispensing tableware. It is an additional feature of the present disclosure to provide a container that is particularly useful for holding tableware for picnics and other outdoor activities in which meals are served.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A container for tableware said container comprising:

a housing defining a first compartment, a second compartment and a third compartment;

wherein said first compartment, said second compartment and said third compartment are removably attachable together;

wherein at least one of said first compartment, said second compartment and said third compartment comprises at least three chambers;

wherein said second compartment comprises a napkin support configured for holding napkins;

wherein said first compartment comprises an upper portion extending to a top of said first compartment, and a lower portion extending to a bottom of said first compartment, wherein when said second compartment is attached to said upper portion of said first compartment, said second compartment defines an upper chamber that extends above said top of said first compartment and above said napkin support, and when said third compartment is attached to said lower portion of said first compartment, said third compartment defines a lower chamber that extends below said bottom of said first compartment;

wherein said first compartment, said second compartment and said third compartment are each configured for receiving a different variety of said tableware; and wherein said napkin support extends across said upper chamber and defines an opening for passing napkins therethrough.

2. The container of claim 1, further comprising a handle for carrying said container, said handle being pivotally attached to opposite sides of said housing to allow said handle to rotate from a position against said housing to an upward position for carrying said container.

3. The container of claim 1, wherein said second compartment is configured to snap fit onto said first compartment.

4. The container of claim 1, further comprising a handle for carrying said container, wherein said handle is disposed on said first compartment, said handle being pivotally attached to opposite sides of said housing to allow said handle to rotate from a position against said housing to an upward position for carrying said container;

wherein said first compartment comprises a knife chamber, a fork chamber, a spoon chamber and at least one cup chamber;

wherein said at least one cup chamber comprises a cup support for holding a cup in place;

wherein said third compartment is configured for receiving plates;

wherein said first compartment comprises a height that is at least half of the height of the container;

wherein said housing is cylindrical;

wherein a plurality of spaced apart recesses are formed in said upper portion of said first compartment to facilitate grasping an underside of said second compartment to remove said second compartment from said first compartment;

wherein said first compartment comprises a floor enclosing said at least three chambers at said lower portion of said first compartment, and said at least three chambers are open at said upper portion of said first compartment when said second compartment is removed, and wherein said at least three chambers extend a majority height of said first compartment from said bottom of said first compartment to said top of said first compartment; and wherein at least one of said second compartment and said third compartment is attachable to said first compartment with a threaded engagement.

5. The container of claim 1, wherein at least one of said second compartment and said third compartment is attached to said first compartment with a threaded engagement.

6. The container of claim 1, further comprising a plurality of spaced apart recesses positioned in said upper portion of said first compartment to facilitate grasping an underside of said second compartment to remove said second compartment from said first compartment.

7. The container of claim 1, further comprising a divider forming said at least three chambers, said divider extending to and terminating at a floor within said lower portion of said first compartment.

8. The container of claim 1, wherein said first compartment comprises a floor enclosing said at least three chambers at said lower portion of said first compartment, and said at least three chambers are open at said upper portion of said first compartment when said second compartment is removed, and wherein said at least three chambers extend a majority height of said first compartment from said bottom of said first compartment to said top of said first compartment.

9. A container for tableware, said container comprising:

a cylindrical housing defining a first compartment having a divider forming a plurality of chambers, said divider extending from a lower portion of said first compartment toward an upper portion of said first compartment, said plurality of chambers being configured for receiving utensils extending lengthwise in a direction from said lower portion of said first compartment toward said upper portion of said first compartment;

a second compartment removably attachable to said upper portion of said first compartment, said second compartment comprising a napkin support configured for holding napkins, said napkin support extending across said second compartment and defining an opening for passing napkins therethrough, said second compartment defining an upper chamber that extends above said upper portion of said first compartment and said napkin support when said second compartment is attached to said first compartment; and a handle joined to said housing to facilitate carrying said housing.

10. The container of claim 9, further comprising a third compartment removably attachable to said lower portion of said first compartment.

11. The container of claim 10, wherein when said third compartment is attached to said lower portion of said first compartment, said third compartment defines a lower chamber that extends below said lower portion of said first compartment.

12. The container of claim 11, wherein at least one of said second compartment and said third compartment is attached to said first compartment with a threaded engagement.

13. The container of claim 9, wherein said first compartment comprises one or more recesses for allowing access to an underside of said second compartment.

14. A container for tableware, said container comprising:

a housing defining a first compartment, a second compartment and a third compartment, said first compartment comprising means for separating utensils;

said second compartment comprising means for receiving napkins;

said third compartment comprising means for receiving plates; and attachment means for removably attaching said first compartment, said second compartment and said third compartment;

wherein said means for receiving napkins is configured for receiving napkins outside of said first compartment when said second compartment is attached to said first compartment, and said means for receiving plates is configured for receiving plates outside of said first compartment when said third compartment is attached to said first compartment.

15. The container of claim 14, wherein said first compartment further comprises means for dispensing cups.

16. The container of claim 14, wherein said second compartment is removably attachable to an upper portion of said first compartment.

17. The container of claim 16, wherein said third compartment is removably attachable to a lower portion of said first compartment.

18. The container of claim 14, wherein said attachment means comprises a threaded engagement disposed on at least one of the second compartment and the third compartment.

19. The container of claim 14, wherein said attachment means comprises a snap fit engagement.

20. The container of claim 14, wherein said means for separating utensils comprises a divider for separating knives, spoons and forks into three separate chambers.

21. The container of claim 20, wherein said divider extends from a floor within a lower portion of said first compartment towards an upper portion of said first compartment such that said three separate chambers extend a majority height of said first compartment.

22. The container of claim 14, wherein said means for receiving napkins includes a napkin support extending across said second compartment and defining an opening for passing napkins therethrough.

23. The container of claim 14, wherein said housing is cylindrical.

24. A container for tableware, said container comprising:

a cylindrical housing defining a first compartment having a divider forming a plurality of chambers, said divider extending from a floor within a lower portion of said first compartment toward an upper portion of said first compartment such that said divider and said plurality of chambers extend a majority of a height of said first compartment from said lower portion to said upper portion, and said plurality of chambers are open in said upper portion to allow access to said plurality of chambers, said plurality of chambers comprising a knife chamber, a spoon chamber, a fork chamber and at least one cup chamber, said knife chamber, spoon chamber and fork chamber being configured to maintain one or more knives, spoons, and forks, respectively, in an upright orientation extending lengthwise from said lower portion of said first compartment toward said upper portion of said first compartment, said cup chamber being configured to maintain one or more cups stacked together in a lengthwise orientation extending from said lower portion of said first compartment toward said upper portion of said first compartment;

a third compartment removably attachable to said lower portion of said first compartment such that when said third compartment is attached to said first compartment, said third compartment defines a lower chamber that is positioned below said first compartment;

a handle joined to said housing to facilitate carrying said housing;

a second compartment removably attachable to said upper portion of said first compartment;

wherein when said second compartment is attached to said upper portion of said first compartment, said second compartment defines an upper chamber that is positioned above said upper portion of said first compartment;

wherein at least one of said second compartment and said third compartment is attached to said first compartment with a threaded engagement; and a napkin support extending across said second compartment and defining an opening for passing napkins therethrough.

25. A container for tableware, said container comprising:

a cylindrical housing defining a first compartment, a second compartment and a third compartment;

wherein said first compartment, said second compartment and said third compartment are removably attachable together, wherein at least one of said second compartment and said third compartment is attachable to said first compartment with a threaded engagement;

wherein at least one of said first compartment, said second compartment and said third compartment comprises at least three chambers; and wherein said second compartment defines an upper chamber extending above said first compartment when said second compartment is attached to said first compartment, said second compartment further comprises a napkin support extending across said upper chamber for holding napkins within said upper chamber, said napkin support defining an opening for passing napkins therethrough.

26. The container of claim 25, wherein when said third compartment is attached to said first compartment, said third compartment defines a lower chamber that is positioned below said first compartment.

* * * * *